United States Patent [19]

Distel

[11] Patent Number: 4,888,580

[45] Date of Patent: Dec. 19, 1989

[54] CHILD PROTECTOR

[76] Inventor: Kenneth Distel, 58 W. District Rd., Unionville, Conn. 06085

[21] Appl. No.: 263,508

[22] Filed: Oct. 27, 1988

[51] Int. Cl.[4] ..... G08B 13/02

[52] U.S. Cl. ..... 340/573; 335/205

[58] Field of Search ..... 340/573, 568, 574, 693, 340/571; 335/205, 206, 207, 285; 200/61.93, 61.19, DIG. 2, DIG. 8, 61, 62; 128/782

[56] References Cited

U.S. PATENT DOCUMENTS

| | | | |
|---|---|---|---|
| 3,896,427 | 7/1975 | Campman | 340/572 |
| 4,536,754 | 8/1985 | Holce et al. | 340/568 |
| 4,598,272 | 7/1986 | Cox | 340/573 |
| 4,665,389 | 5/1987 | Clendening | 340/574 |

*Primary Examiner*—Michael J. Tokar

*Attorney, Agent, or Firm*—Fishman, Dionne & Cantor

[57] ABSTRACT

A device is presented which warns parents that their children are being abducted by sounding an alarm. The alarm is wired to a battery and a magnetic switch comprised of two magnets. When the two magnets are separated the alarm sounds. The magnets are situated in a manner in which one magnet opposes the other magnet. An attachment mechanism may be used to hold the two magnets in place. The magnets may be situated in a stuffed animal or the like. One magnet has a string attached, which is further attached to the child. When the child is separated from the stuffed animal, the magnets are separated and the alarm sounds warning parents that their child is in danger.

14 Claims, 1 Drawing Sheet

CHILD PROTECTOR

BACKGROUND OF THE INVENTION

This invention relates generally to an alarm device. More particularly, this invention relates to an alarm device for warning a parent that their child is being abducted.

Child abduction is a major problem. The number of children being abducted each year is growing. As many as 150,000 children are reported missing annually. Many of the abductions occur when the child is in close proximity to a parent. Abductions occur in stores, schoolyards, even at home.

The present invention relates to an alarm device which warns parents that their children have been separated from the place where the parents left the child. Many different alarm devices are known in the prior art. Some of these are hand-held devices. A typical hand-held device is described in U.S. Pat. No. 4,633,233 to Nelson. This device incorporates an alarm housed within a hand size enclosure. The alarm is triggered by the individual. The triggering switch is mechanical and located within the enclosure. This device is designed for personal security; not for protecting children.

Another hand-held device is shown in U.S. Pat. No. 3,248,723 to Meithe. This device is a battery operated position responsive unit very similar to a flashlight. The device is primarily intended to be worn on clothing and to detect if the wearer has fallen. If it is used to protect an individual from an assailant, or to protect a child from abduction, the device is easily deactivated by either the assailant or abductor.

Another prior art device is described in U.S. Pat. No. 4,694,284 to Leveille et al. This device comprises a radio transmitter incorporated into a lockable collar. The radio transmitter must be activated by the wearer. The unit cannot be deactivated until it is unlocked. The signal transmitted aids the police in discovering the abducted individual.

SUMMARY OF THE INVENTION

The present invention overcomes the above discussed disadvantages and other deficiencies of the prior art by Providing an alarm device which is automatically triggered upon abduction of a child. The device is comprised of an alarm, a Power supply, a housing, a separable magnetic switch assembly and other necessary components.

The alarm, switch and power supply are wired in series. The magnetic switch is comprised of two magnets. When the two magnets are in contact, the switch is open and no current passes through the switch. When the two magnets are separated, the switch is closed and current passes through the switch. The power supply is a battery.

The battery and buzzer are enclosed within a housing. One magnet of the magnetic switch is wired in series to the battery and buzzer. This magnet can be enclosed within the housing or located beyond the enclosure of the housing. The second magnet of the magnetic switch is independently attached to another object other than the housing and is in contact with the first magnet.

The housing which encloses the buzzer, battery and the first magnet can be located within the childs garments, inside a Teddy Bear or other stuffed animal, or within any conveniently hidden location on or near a child. The second magnet opposes the first and is attached to an object other than that in which the housing and related components are located. If a child strays from its location or is abducted, the two magnets of the magnetic switch will be separated and the alarm will sound.

The circuit of the present invention comprises the battery, the buzzer, and the magnetic switch which are all wired in series. When the magnetic switch is closed, the full voltage of the power supply passes through the buzzer, and it buzzes. To close the magnetic switch, the two magnets which comprise the switch are separated, thus sounding the buzzer.

Other advantages of the present invention will be apparent to and understood by those skilled in the art by the following detailed description and drawing.

DESCRIPTION OF THE DRAWINGS

Referring now to the drawings, wherein like elements are numbered alike in the several Figures.

DESCRIPTION OF THE INVENTION

Figure 1:
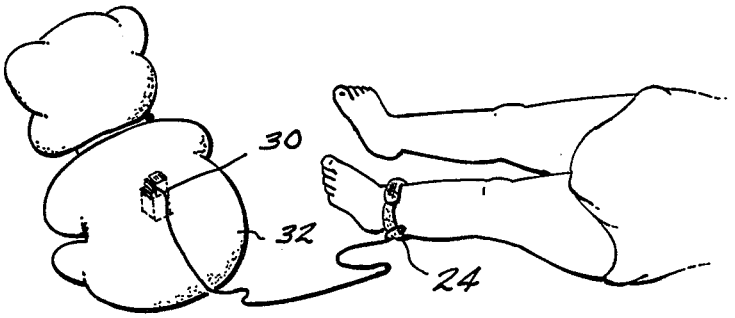
FIG. 1 shows the child protector located within a Teddy-Bear and attached to a childs foot.
Figure 2:
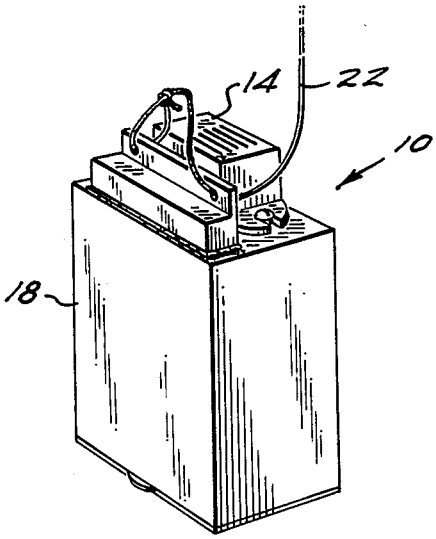
FIG. 2 is a front perspective view of a child protector, in accordance with the present invention.
Figure 3:
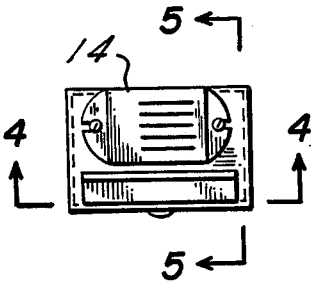
FIG. 3 is a top elevation view of the child protector shown in FIG. 1.
Figure 4:
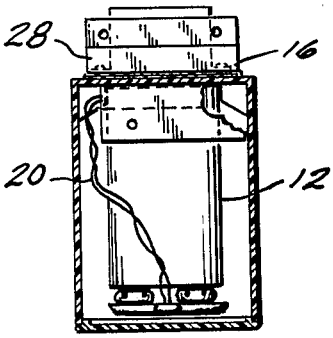
FIG. 4 is a cross-sectional view along line 4—4 of FIG. 2.

Referring jointly to FIGS. 1 through 4, a child protector is shown generally at 10. Child protector 10 is comprised of a power supply 12 (battery), an alarm 14 (buzzer), a magnetic switch 16, a housing 18, conductive wire 20, string 22 and hook and loop fastening material 24.

Battery 12 is wired in series to buzzer 14 and magnetic switch 16. Magnetic switch 16 is comprised of two magnets. One magnet 26 is wired, the other magnet 28 is the same size as magnet 26, but not wired. A first end of string 22 is attached to magnet 28 while hook and loop fastening material 24 is attached to the opposite end of string 22. Battery 12 and buzzer 14 are positioned within housing 18. Magnet 26 can be located either within or outside of housing 18. Conductive wire 20 electronically connects battery 12, buzzer 14 and magnetic switch 16.

Figure 5:
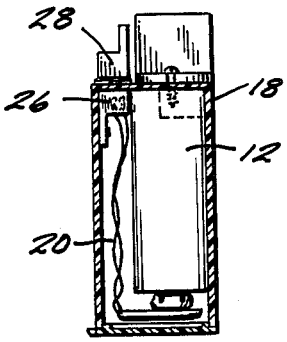
FIG. 5 is a cross-section view along line 5—5 of FIG. 2.

Housing 18, battery 12, buzzer 14 and magnet 26 will be referred to as the buzzer unit 30. Buzzer unit 30 can be implanted in a childs clothing, a stuffed animal (as shown in FIG. 5), a baby buggy or any other conveniently hidden location on or near a child. The ideal location for the buzzer unit 30 is on the child. Magnet 28 is connected opposite from magnet 26. Magnet 28 is attached to string 22 and hook and loop fastening material strap 24. Hook and loop fastening material strap 24 can be fit around any object to secure magnet 28.

Figure 6:
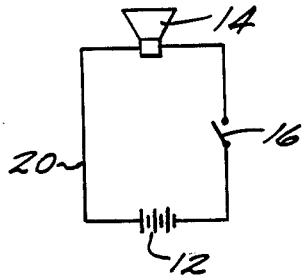
FIG. 6 is a electrical schematic of the child protector of FIG. 1.

Electric circuit 32 shown in FIG. 6 is very simple. Buzzer 14 is wired in series with magnetic switch 16 and battery 12. While magnets 26 and 28 are in contact, switch 16 is open. When magnets 26 and 28 are separated, switch 16 is closed and current flows through buzzer 14, thus sounding buzzer 14.

Separation of magnets 26 and 28 occurs when the object containing buzzer unit 30 is separated from magnet 28. In the preferred embodiment buzzer unit 30 is attached to a childs article of clothing, so that the buzzer will indicate the location of the child, and will frighten any abductors when the buzzer sounds. In FIG. 1, buzzer unit 30 is hidden in a stuffed animal 32 and is connected via string 22 to hook and loop material 24 around the ankle of a child 34. If the child is abducted, the string 24 will pull on magnet 28 and thereby break contact with magnet 26. When this magnetic contact is broken, the alarm 14 will sound.

In all cases the buzzer will warn the parents that the child has moved from where the parent has located the child. By signalling to the parent that the child is in danger, reduction in child abductions will result. Because the system is automatically activated it will work quite effectively in reducing kidnapping and it can be used with children of many ages.

It will be appreciated that the several components of the present invention including the magnetic switch, alarm and battery are all known and commercially available.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A device for detecting movement of an infant, comprising:

housing means;

alarm circuit means secured to said housing means, said circuit means comprising alarm means and power supply means;

first plate means, secured to said housing means;

switch means for interrupting said power supply means, mounted through said first plate means, said switch means having an open position and a closed position and said switch means being urged into the closed position;

second plate means, removably securable to said first plate means by magnetic attraction so that the switch means is held in the open position when the second plate means is secured to the first plate means and the switch means is allowed to enter the closed position when the second plate means is removed from the first plate means;

a leash extending from a first end to a second end, said first end being secured to the second plate means; and attachment means secured to the second end of the leash.

2. The device of claim 1, wherein the attachment means comprises means for attaching the leash to a substrate.

3. The device of claim 1, wherein the attachment means comprises means for attaching the leash to the infant.

4. The device of claim 3, wherein the means for attaching the leash to the infant comprises an adjustable bracelet.

5. The device of claim 1, further comprising attachment means for attaching the housing to a substrate.

6. The device of claim 1, further comprising attachment means for attaching the housing to the infant.

7. The device of claim 1, wherein:

the housing means comprises a stuffed animal toy.

8. The device of claim 1, wherein:

the alarm means comprises an audible buzzer.

9. The device of claim 1, wherein:

the first and second plate means each comprise a magnet.

10. A method for detecting movement of an infant, comprising:

providing a detection device, said device comprising:

housing means;

alarm circuit means secured to said housing means, said circuit means comprising alarm means and power supply means;

first plate means, secured to said housing means;

switch means for interrupting said power supply means, mounted through said first plate means, said switch means having an open position and a closed position and said switch means being urged into the closed position;

second plate means, removably securable to said first plate means by magnetic attraction so that the switch means is held in the open position when the second plate means is secured to the first plate means and the switch means is allowed to enter the closed position when the second plate means is removed from the first plate means;

a leash having a preselected length and extending for a first end to a second end, said first end being secured to the second plate means; and attachment means, secured to the second end of the leash; and attaching the attachment means to the infant so that movement of the infant a distance from the housing that is greater than the length of the leash removes the second plate means from the first plate means to activate the alarm means.

11. The method of claim 10, wherein:

the attachment means comprises an adjustable bracelet.

12. The method of claim 10, wherein:

the housing is concealed within a stuffed animal.

13. The method of claim 10, further comprising:

securing the housing to a substrate.

14. A method for detecting movement of an infant, comprising:

providing a detection device, said device comprising:

housing means;

first attachment means for attaching the housing means to the infant;

alarm circuit means secured to said housing means, said circuit means comprising alarm means and power supply means;

first plate means, secured to said housing means;

switch means for interrupting said power supply means, mounted through said first plate means, said switch means having an open position and a closed position and said switch means being urged into the closed position;

second plate means, removably securable to said first plate means by magnetic attraction so that the switch means is held in the open position when the second plate means is secured to the first plate means and the switch means is allowed to enter the closed position when the second plate means is removed from the first plate means;

a leash having a preselected length and extending from a first end to a second end, said first end being secured to the second plate means; and second attachment means, secured to the second end of the leash; and attaching the first attachment means to the infant; and attaching the second attachment means to a substrate so that movement of the infant a distance from the substrate that is greater than the length of the leash removes the second plate means for the first plate means to activate the alarm means.

* * * * *